United States Patent [19]

Hedel

[11] 4,375,854

[45] Mar. 8, 1983

[54] STONE SORTING APPARATUS AND METHOD

[75] Inventor: Rudolph H. Hedel, West Windsor, N.J.

[73] Assignee: RCA Corporation, New York, N.Y.

[21] Appl. No.: 249,613

[22] Filed: Mar. 31, 1981

[51] Int. Cl.[3] ..... B07C 5/00

[52] U.S. Cl. ..... 209/643; 209/702; 209/921; 209/916; 209/942; 356/30; 221/254

[58] Field of Search ..... 209/702, 614, 643, 921, 209/916, 942; 221/164, 165, 166, 268, 271-276, 254, 211; 356/30, 31

[56] References Cited

U.S. PATENT DOCUMENTS

| | | | |
|---|---|---|---|
| 2,354,628 | 7/1944 | Whitesell | 209/942 X |
| 2,756,903 | 7/1956 | Kriedler | 221/166 X |
| 2,759,391 | 8/1956 | Lehman | 209/643 X |
| 3,010,609 | 11/1961 | Jolly | 221/254 |
| 3,610,756 | 10/1971 | Lenzen | 356/30 |
| 3,721,465 | 3/1973 | Kraissl, Jr. | 294/64 R |
| 3,730,342 | 5/1973 | Egan | 209/643 |
| 3,845,284 | 10/1974 | Taguchi et al. | 235/150.1 |
| 4,259,011 | 3/1981 | Crumm | 356/30 |

OTHER PUBLICATIONS

J. P. G. Dunman, Vacuum Operated Pickup Probe, IBM Technical Disclosure Bulletin, vol. 12, No. 8, Jan. 1970.

*Primary Examiner*—Allen N. Knowles

*Attorney, Agent, or Firm*—Birgit E. Morris; Donald S. Cohen; Thomas H. Magee

[57] ABSTRACT

A stone sorting apparatus for viewing stones individually through a microscope includes a platform having a reservoir adjacent a surface thereof for storing the stones. One end of a rod projects upward through an opening disposed at the bottom of the reservoir, the rod adapted to slide along the opening, and having at the one end a concave indentation facing upward and shaped to support one of the stones. Connected to the other end of the rod is means for sliding the one end of the rod between a first position within the reservoir, and a second position outside the reservoir, whereat the one end is positioned exactly within the field of view of an objective of the microscope such that a stone supported by the indentation is disposed precisely at the focal length of the microscope objective.

7 Claims, 3 Drawing Figures

STONE SORTING APPARATUS AND METHOD

This invention relates to a method and apparatus for sorting synthetic diamond stones by viewing the stones individually through a microscope.

BACKGROUND OF THE INVENTION

Information playback systems frequently utilize a stylus for reading signals from the surface of an information record, typically a plastic disc, that contains stored video and audio information. In some systems, the information record has a fine spiral groove to guide the tip of a stylus that contains a thin electrode. In these systems, the stylus tip is made of a material having sufficient hardness to withstand the abrasion caused from tracking the groove. Materials which possess such hardness, such as diamond, generally have a crystallographic structure which presents surfaces exhibiting different qualities depending upon which crystallographic plane the surfaces are oriented along. Making a long-shanked stylus entirely from the same material may become expensive, particularly when the tip material, for example diamond, exceeds the cost of other suitable materials from which the shank can be made.

In order to reduce manufacturing costs, the shank of the stylus may be made from a different material which is less expensive than the crystallographic tip material. For example, a small diamond stone may be mounted at the end of a relatively long metallic shank, such as a cylindrical titanium rod. The diamond stone utilized may be a synthetic diamond stone which is less expensive to obtain than a natural diamond stone. The synthetic stone is grown spontaneously in a high-pressure apparatus, containing a metal-carbon system, upon melting of the metal which is in mechanical contact with the graphite. The synthetic diamond stone has a plurality of facets oriented along the {100} family of planes and a plurality of facets oriented along the {111} family of planes. The stone typically comprises an extremely small cubo-octahedron stone having six {100} facets and eight {111} facets, with an average facet-to-facet thickness of approximately 300 micrometers. In actual samples, the facets, along a specific family of planes, are shaped differently and have different surface area sizes, some of which are not desirable for use in stylus tip fabrication. Also, some of the synthetic stones have surface defects which can be discovered by visual examination under a microscope. The present invention provides a novel method and apparatus for sorting synthetic diamond stones in order to determine which of the stones are to be utilized in fabricating metallic-shanked styli.

SUMMARY OF THE INVENTION

The present invention comprises a stone sorting apparatus for viewing stones individually through a microscope. The apparatus includes a platform having a reservoir adjacent a surface thereof for storing the stones. One end of a rod projects upward through an opening disposed at the bottom of the reservoir, the rod adapted to slide along the opening, and having at the one end a concave indentation facing upward and shaped to support one of the stones. Connected to the other end of the rod is means for sliding the one end of the rod between a first position within the reservoir, and a second position outside the reservoir, whereat the one end is positioned exactly within the field of view of an objective of the microscope such that a stone supported by the indentation is disposed precisely at the focal length of the microscope objective.

DETAILED DESCRIPTION OF THE PREFERRED EMBODIMENT

Figure 1:
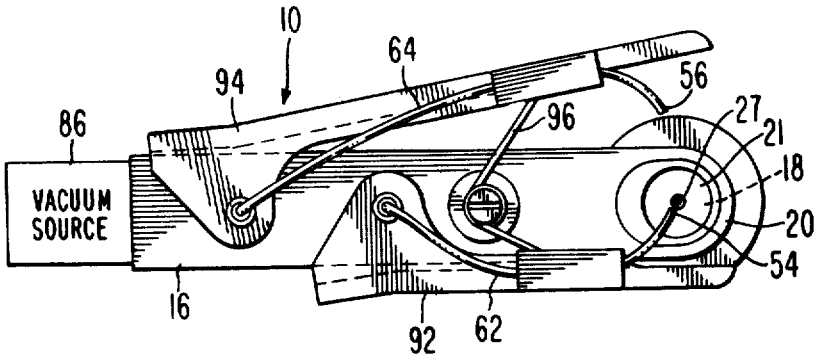
FIG. 1 is a plan view showing a preferred embodiment of the novel stone sorting apparatus.
Figure 2:
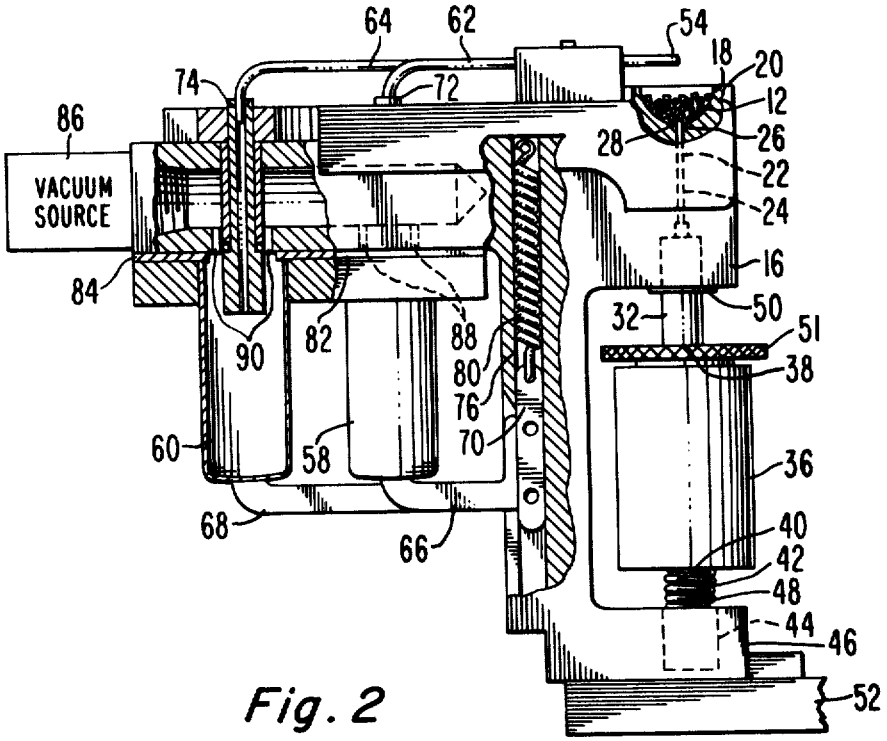
FIG. 2 is an elevation view of the novel stone sorting apparatus in a first position, with sections thereof broken away.
Figure 3:
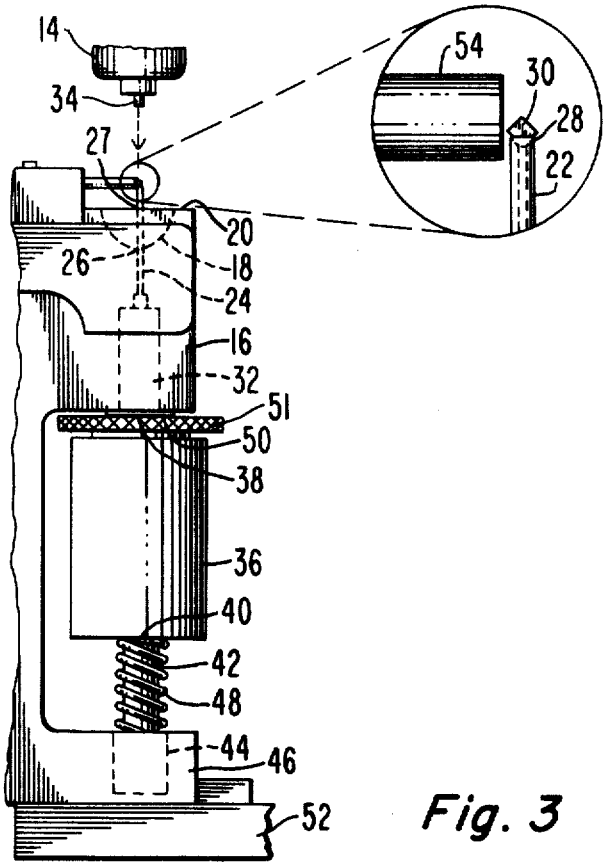
FIG. 3 is a partial elevation view of the novel stone sorting apparatus in a second position.

In FIGS. 1 and 2 of the drawing, there is shown one embodiment of a stone sorting apparatus 10 for viewing stones 12 individually through a microscope 14. The apparatus 10 comprises a platform 16 having a reservoir 18 adjacent a surface 20 thereof for storing the stones 12. A top cover 21 is disposed over the reservoir 18. One end 22 of a rod 24 projects upward through an opening 26 disposed at the bottom of the reservoir 18. The rod 24 is adapted to slide along the opening 26 and through an aperture 27 in the top cover 21, and has at the one end 22 a concave indentation 28 facing upward and shaped to support one of the stones 12, which is illustrated in FIG. 3 as a sample stone 30. The indentation 28 is shaped so that it will support only one of the stones 12, which is held therein by the force of gravity. The stones 12 comprise synthetic diamond stones having the shape of a cubo-octahedron with a facet-to-facet thickness of about 300 micrometers. In the present embodiment, the rod 24 comprises a stainless steel hypodermic needle having an outer diameter of about 400 micrometers. If desirable, a source of vacuum may be applied to the indentation 28, via a conduit in the rod 24, to further assist in holding the sample stone 30 adjacent the one end 22.

Connected to the other end 32 of the rod 24 is means for sliding the one end 22 of the rod 24 between a first position within the reservoir 18, and a second position outside the reservoir 18. At the second position, the one end 22 is positioned exactly within the field of view of an objective 34 of the microscope 14, such that the sample stone 30 supported by the concave indentation 28 is disposed precisely at the focal length of the microscope objective 34, as shown in FIG. 3. In the preferred embodiment, the sliding means is supported by the platform 16 and includes an actuating sleeve 36 having the top end 38 thereof affixed to the other end 32 of the rod 24, and the bottom end 40 thereof affixed to a shaft 42 adapted to slide within a casing 44 disposed within a bottom portion 46 of the platform 16. A spring 48 surrounds the shaft 42 between the bottom end 40 of the sleeve 36 and the bottom portion 46 of the platform 16. The spring 48 is adapted to hold the top end 38 of the actuating sleeve 36 firmly against a top portion 50 of the platform 16, as illustrated in FIG. 3, so that the one end 22 of the rod 24 is disposed precisely at the second position. An adjustable wheel 51 is disposed adjacent the top end 38 for adjusting the height of the one end 32 of the rod 24 in order that the one end 22 be positioned precisely at the focal length of the microscope objective 34 when at the second position. The position of the platform 16 is always fixed in relation to the position of the microscope 14. Preferably, the bottom edge 52 of the platform 16 is affixed to the base (not shown) of the microscope 14.

In the present embodiment, the apparatus 10 further comprises a first and a second suction nozzle 54 and 56 disposed above the platform surface 20, and in pathway communication with, respectively, an accept container 58 and a reject container 60. Each of the nozzles 54 and 56 is adapted to transport therethrough a stone 12, held adjacent thereto, to the respective container 58 or 60 upon application of a vacuum thereto. In the present example, the first and the second nozzles 54 and 56 comprise, respectively, the ends of stainless steel hypodermic tubing sections 62 and 64, which are utilized to transport the stones 12 to the appropriate containers 58 and 60. The accept and reject containers 58 and 60 are held, respectively, by support arms 66 and 68, both of which are attached to a connecting rod 70 adapted to hold the accept and reject containers 58 and 60 adjacent, respectively, vacuum tube guides 72 and 74. The vacuum tube guides 72 and 74 are affixed to the platform 16 and are connected, respectively, to the ends of the tubing sections 62 and 64, as shown in FIG. 2. The connecting rod 70 slides back and forth in a cylinder 76 within the platform 16, and is attached to a spring 80 adapted to bias the connecting rod 70 upwards, so that the containers 58 and 60 are pressed firmly against sealing gaskets 82 and 84 which surround, respectively, the vacuum tube guides 72 and 74.

A source 86 of vacuum is connected to the accept and reject containers 58 and 60 via, respectively, openings 88 and 90 which access the containers 58 and 60 adjacent the vacuum tube guides 72 and 74, as illustrated in FIG. 2. Thus, the vacuum source 86 is ultimately applied at the first and the second suction nozzles 54 and 56 via, respectively, the containers 58 and 60 and the tubing sections 62 and 64. The vacuum source 86 should be sufficient to cause a stone 12, disposed adjacent one of the nozzles 54 and 56, to be transported therethrough via the respective tubing sections 62 and 64 and deposited in the respective containers 58 and 60.

First and second means are supported by the platform 16 and connected, respectively, to the first and the second nozzles 54 and 56 for moving, respectively, the first and the second nozzles 54 and 56 between a pick-up position and a retracted position. The pick-up position is located adjacent the sample stone 30 supported by the indentation 28 when the one end 22 of the rod 24 is disposed at the second position, while the retracted position is located away from the pick-up position. In the present embodiment, the first and the second moving means comprise, respectively, first and second pick-up arms 92 and 94 rotatably connected to the platform 16. The pick-up arms 92 and 94 are biased in the retracted position by a spring 96, as illustrated by the pick-up arm 94 in FIG. 1. By applying a small force thereto, an operator is able to individually move the pick-up arms 92 and 94 from the retracted position to the pick-up position. Upon removal of this force, the spring 96 returns the pick-up arms 92 and 94 to the retracted position.

The present method of sorting the stones 12 by viewing the stones 12 individually through the microscope 14 comprises the first step of depositing the stones 12 into the reservoir 18. An operator then places the one end 22 of the rod 24 at the first position within the reservoir 18, as illustrated in FIG. 2. This placing step is performed by the operator contacting the actuating sleeve 36, and pulling the sleeve 36 downward against the biasing force of the spring 48 until the one end 22 of the rod 24 is disposed at the first position within the reservoir 18.

The one end 22 of the rod 24 is then slid upward, with the sample stone 30 being supported by the concave indentation 28, from the first position to the second position outside the reservoir 18, whereat the one end 22 is positioned exactly within the field of view of the microscope objective 34. Since the sample stone 30 is now disposed precisely at the focal length of the microscope objective 34, the operator may easily determine whether the sample stone 30 is to be rejected or accepted by visually observing the sample stone 30 through the microscope 14.

After making this determination, the operator, with the vacuum source 86 being applied, moves either the first suction nozzle 54 or the second suction nozzle 56 to the pick-up position located adjacent the sample stone 30 depending, respectively, upon whether the sample stone 30 is to be accepted or rejected. By applying a small force to the respective pick-up arm (92 in FIG. 1), the operator moves the pick-up arm 92 from the retracted position to the pick-up position, as shown in FIG. 1. The sample stone 30 is sucked through the adjacent nozzle and tubing (54 and 62 in FIG. 1) and deposited in the respective container, which is the accept container 58 if the stone 30 is to be accepted. The respective suction nozzle (54 in FIG. 1) is then returned to the retracted position away from the pick-up position by means of the biasing spring 96, when the operator releases his hand from the respective pick-up arm 92. The above-described sequence of events is then repeated with another stone 12 from the reservoir 18.

The present invention provides an efficient handling apparatus by which to visually inspect a large number of synthetic diamond stones in rapid succession. It is emphasized that the synthetic stones are extremely small, having a typical facet-to-facet thickness of about 300 micrometers. The relatively small reservoir 18 will contain several thousand synthetic stones, each needing to be visually examined prior to being further processed. Since the synthetic stone is so small, it would be time consuming to have to not only manually handle each stone but also to manually locate the stone each time in the field of view of the microscope 14. The present invention provides an efficient apparatus and method which allows each individual stone to be automatically placed precisely in the field of view of the microscope 14, ready for visual examination by the operator. By using the present apparatus 10, the operator in effect has to only pull the actuating sleeve 36 downward and then allow it to slide upward, look through the microscope 14, and then move the appropriate pick-up arm 92 or 94 to the pick-up position, thereby making possible the rapid sorting of a large number of stones.

What is claimed is:

1. A stone sorting apparatus for viewing stones individually through a microscope comprising:

a platform having a reservoir adjacent a surface thereof for storing said stones, a rod having one end thereof projecting upward through an opening disposed at the bottom of said reservoir, said rod adapted to slide along said opening, and having at said one end a concave indentation facing upward and shaped to support one of said stones, means connected to the other end of said rod for sliding the one end of said rod between a first position within said reservoir, and a second position outside said reservoir, whereat said one end is positioned exactly within the field of view of an objective of said microscope such that a stone supported by said indentation is disposed precisely at the focal length of said microscope objective, a first and a second suction nozzle disposed above said platform surface and in pathway communication with, respectively, an accept container and a reject container, each of said nozzles adapted to transport therethrough a stone, held adjacent thereto, to the respective container upon application of a vacuum thereto, a source of vacuum connected to said accept container and said reject container, and first and second means, supported by said platform and connected, respectively, to said first and said second nozzles, for moving, respectively, said first and said second nozzles between a pick-up position located adjacent a stone supported by said indentation when the one end of said rod is disposed at said second position, and a retracted position located away from said pick-up position.

2. An apparatus as defined in claim 1 wherein said first and said second moving means comprise, respectively, first and second pick-up arms rotatably connected to said platform and biased in the retracted position by a spring.

3. An apparatus as defined in claim 1 wherein said sliding means is supported by said platform and comprises:

an actuating sleeve having the top end thereof affixed to the other end of said rod and the bottom end thereof affixed to a shaft adapted to slide within a casing disposed within a bottom portion of said platform, and a spring surrounding said shaft between the bottom end of said sleeve and the bottom portion of said platform, said spring adapted to hold the top end of said sleeve firmly against a top portion of said platform, so that the one end of said rod is disposed precisely at said second position.

4. An apparatus as defined in claim 1 wherein said rod comprises a needle having an outer diameter of about 400 micrometers.

5. A method of sorting stones by viewing said stones individually through a microscope comprising the steps of:

detecting said stones into a reservoir adjacent a surface of a platform, placing one end of a rod at a first position within said reservoir, the one end of said rod projecting upward through an opening disposed at the bottom of said reservoir, and having a concave indentation facing upward and shaped to support one of said stones, said placing step being performed by contacting an actuating sleeve having the top end thereof affixed to the other end of said rod and the bottom end thereof affixed to a slidable shaft, said sleeve being biased by a spring adapted to hold the top end of said sleeve firmly against a top portion of said platform, so that the one end of said rod is disposed precisely at a second position outside said reservoir whereat said one end is positioned exactly within the field of view of an objective of said microscope such that said sample stone is disposed precisely at the focal length of said microscope objective, and pulling said sleeve downward against the biasing force of said spring until the one end of said rod is disposed at said first position within said reservoir, sliding the one end of said rod upward, with a sample stone being supported by said indentation, from said first position to said second position, determining whether said sample stone is to be accepted or rejected by visually observing the sample stone through said microscope when the one end of said rod is disposed at said second position, applying a source of vacuum to an accept container and a reject container, said accept and said reject containers being in pathway communication with, respectively, a first and a second suction nozzle disposed above said platform surface, each of said nozzles adapted to transport therethrough a stone, held adjacent thereto, to the respective container, moving either said first or said second suction nozzle to a pick-up position located adjacent said sample stone depending, respectively, upon whether said sample stone is to be accepted or rejected, whereby said sample stone is transported therethrough to the respective container, and returning the suction nozzle located at said pick-up position to a retracted position located away from said pick-up position.

6. A method as recited in claim 5 wherein said sliding step is performed by allowing the biasing force of said spring to push said sleeve upward until the one end of said rod is disposed at said second position outside said reservoir.

7. A method as recited in claim 6 wherein said stones comprise synthetic diamond stones having the shape of a cubo-octahedron with a facet-to-facet thickness of about 300 micrometers.

* * * * *